US011951536B2

(12) United States Patent
McCallum et al.

(10) Patent No.: US 11,951,536 B2
(45) Date of Patent: Apr. 9, 2024

(54) SYSTEM AND METHOD FOR MONITORING INGOT DETACHMENT FROM BOTTOM BLOCK

(71) Applicant: Novelis Inc., Atlanta, GA (US)

(72) Inventors: John Robert Buster McCallum, Spokane, WA (US); Aaron David Sinden, Valleyford, WA (US)

(73) Assignee: Novelis Inc., Atlanta, GA (US)

( * ) Notice: Subject to any disclaimer, the term of this patent is extended or adjusted under 35 U.S.C. 154(b) by 0 days.

(21) Appl. No.: 18/005,749

(22) PCT Filed: Jul. 23, 2021

(86) PCT No.: PCT/US2021/042975
§ 371 (c)(1),
(2) Date: Jan. 17, 2023

(87) PCT Pub. No.: WO2022/020721
PCT Pub. Date: Jan. 27, 2022

(65) Prior Publication Data

US 2023/0294167 A1 Sep. 21, 2023

Related U.S. Application Data

(60) Provisional application No. 62/705,949, filed on Jul. 23, 2020.

(51) Int. Cl.
*B22D 11/18* (2006.01)
*B22D 11/049* (2006.01)

(52) U.S. Cl.
CPC ..... *B22D 11/185* (2013.01); *B22D 11/049* (2013.01)

(58) Field of Classification Search
CPC ..... B22D 11/185; B22D 11/049
See application file for complete search history.

(56) References Cited

U.S. PATENT DOCUMENTS

2009/0165906 A1 7/2009 Wagstaff et al.

FOREIGN PATENT DOCUMENTS

EP 3546086 A1 10/2019
JP 07314099 A 12/1995

OTHER PUBLICATIONS

Droste et al., "Continuous Monitoring of Butt Curl Development During DC Casting—Development and Application", Light Metals, 2020, pp. 892-900.

(Continued)

*Primary Examiner* — Kevin P Kerns
*Assistant Examiner* — Steven S Ha
(74) *Attorney, Agent, or Firm* — Kilpatrick Townsend & Stockton LLP

(57) ABSTRACT

A monitoring system may monitor a gap between an ingot and a bottom block of a mold. The monitoring system may include a camera and a computer system. The camera may be positioned to capture or detect optical data associated with one or more molds positioned in a casting environment and send the optical data to the computer system. The computer system may compare the optical data with a baseline profile. Based on the comparison between the optical data and the baseline profile, the computer system may determine if the ingot has separated from the bottom block and the height of the separation. The computer system may generate operating instructions based on the separation. The operating instructions may be used to adjust the casting process.

20 Claims, 7 Drawing Sheets

(56) References Cited

OTHER PUBLICATIONS

PCT/US2021/042975 , "International Search Report and the Written Opinion", dated Oct. 5, 2021, 13 pages.
Sengupta et al., "On the Development of a Three-Dimensional Transient Thermal Model to Predict lngot Cooling Behavior during the Start-Up Phase ofthe Direct Chill-Casting Process for an AA5182 Aluminum Alloy lngot", Metallurgical and Materials Transactions B, vol. 358, Jun. 2004, pp. 523-540.
PCT/US2021/042975 , "International Preliminary Report on Patentability", dated Feb. 2, 2023, 9 pages.
RU2022130399 , "Office Action", dated Jul. 28, 2023, 10 pages.

SYSTEM AND METHOD FOR MONITORING INGOT DETACHMENT FROM BOTTOM BLOCK

CROSS-REFERENCE TO RELATED APPLICATION

This application claims the benefit of and priority to U.S. Provisional Application No. 62/705,949, filed on Jul. 23, 2020, and titled "MONITORING INGOT FORMATION," the content of which is herein incorporated by reference in its entirety for all purposes.

FIELD

The present disclosure generally relates to metal casting and more specifically to associated processes and systems for monitoring the metal casting process.

BACKGROUND

Molten metal may be deposited into a mold to create a metal ingot. These metal ingots may be formed using, for example, direct chill (DC) casting or electromagnetic casting (EMC). In DC casting, molten metal is typically poured into a shallow water-cooled mold. The mold may include a bottom block mounted on a telescoping hydraulic table to form a false bottom. The bottom block may be positioned at or near the bottom of the mold prior to the molten metal being deposited into the mold. As molten metal is deposited into the mold, the molten metal may fill the mold cavity, and the outer and lower portions of the mold may be cooled. The molten metal may cool and begin to solidify, forming a shell of solid or semi-solid metal around a molten core. As the bottom block is lowered, additional molten metal may be fed into the mold cavity.

Before, during, and after the casting process, the mold and metal ingot may be monitored by one or more sensors. For example, a metal level sensor may measure the height of the molten metal in the mold. Many of these sensors are placed in and around the mold and often make physical contact with the ingot or the mold. To mitigate the risk of having an operator enter the casting environment and having sensors in contact with the ingot, it may be desirable to monitor the casting process from outside the casting environment using a system that does not make contact with the ingot.

SUMMARY

The term embodiments and like terms are intended to refer broadly to all of the subject matter of this disclosure and the claims below. Statements containing these terms should be understood not to limit the subject matter described herein or to limit the meaning or scope of the claims below. Embodiments of the present disclosure covered herein are defined by the claims below, not this summary. This summary is a high-level overview of various aspects of the disclosure and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this disclosure, any or all drawings, and each claim.

Certain examples herein address systems and methods for monitoring a casting system during a casting process. Various examples utilize casting systems including a launder depositing molten metal into one or more molds during the casting process. At least one of the molds may have a number of sidewalls spanning between a top and a bottom of the mold. The top and bottom of the mold may be open, allowing molten metal to be deposited by the launder through the open top and allowing solidifying metal to exit through the open bottom. The system may include one or more cameras with at least one camera having a field of view including at least a portion of the mold. For example, the field of view of the one or more cameras may include the top of the mold. A computer system may be used to detect one or more events during a casting operation such as the level of the metal in the mold or the distance between the bottom block and a portion of the metal ingot. The computer system may determine an appropriate action and/or warning based on one or more of the detected events.

In various examples, a system for monitoring a casting operation is provided. The system may include a mold defining an opening to receive molten metal, a bottom block lowerable to receive the molten metal, a launder including a flow control device configured to adjust a flow rate of the molten metal from the launder to the mold for casting the molten metal into an ingot, and a water source configured to provide water to the mold. The water may flow from the mold during the casting of the molten metal into the ingot. The system may also include a camera having a field of view including at least a portion of the bottom block and a portion of the ingot and configured to capture optical data associated with the portion of the ingot or the portion of the bottom block, and a controller including a processor configured to execute instructions stored on a non-transitory computer-readable medium in a memory. The controller may cause the processor to perform processor operations including receiving optical data associated with the portion of the ingot or the portion of the bottom block; determining, based on the optical data, whether separation of the portion of the ingot from the portion of the bottom block has occurred; and generating operating instructions for casting the molten metal into the ingot if it was determined that the separation has occurred.

In various examples, a method of monitoring a mold is provided. The method may include initiating a casting operation using a casting system including a mold, a bottom block, and a launder. The casting operation may include causing molten metal to flow into the mold, causing water to flow into the mold, cooling the molten metal to form an ingot, lowering the bottom block, and diverting water away from a portion of the ingot. The method of monitoring may also include capturing, using a camera, first optical data associated with the portion of the ingot; comparing the first optical data with a baseline profile; and determining, based on the comparing, whether the portion of the ingot has separated from the bottom block.

In various examples, a system for monitoring a mold is provided. The system may include a mold defining an opening to receive molten metal and a bottom block lowerable during a casting of the molten metal into an ingot, a launder configured to deliver the molten metal to the mold, a water source configured to provide water to the mold, a diverter configured to divert the water away from a portion of the ingot, a camera having a field of view including at least the portion of the ingot that the water has been diverted away from and configured to capture optical data associated with the ingot, and a controller including a processor configured to execute instructions stored on a non-transitory computer-readable medium in a memory. The controller may cause the processor to perform processor operations including capturing first optical data associated with the portion of the ingot; generating a profile associated with the portion of the ingot based on at least the first optical data; comparing the profile with a baseline profile; and determining, based on the comparing, whether the portion of the ingot has separated from the bottom block.

Other objects and advantages will be apparent from the following detailed description of non-limiting examples.

BRIEF DESCRIPTION OF THE FIGURES

The specification makes reference to the following appended figures, in which use of like reference numerals in different figures is intended to illustrate like or analogous components.

DETAILED DESCRIPTION

As used herein, the terms "invention," "the invention," "this invention," and "the present invention" are intended to refer broadly to all of the subject matter of this patent application and the claims below. Statements containing these terms should be understood not to limit the subject matter described herein or to limit the meaning or scope of the patent claims below. The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described. As used herein, the meaning of "a," "an," and "the" includes singular and plural references unless the context clearly dictates otherwise.

While certain aspects of the present disclosure may be suitable for use with any type of material, such as metal, certain aspects of the present disclosure may be especially suitable for use with aluminum.

All ranges disclosed herein are to be understood to encompass any and all subranges subsumed therein. For example, a stated range of "1 to 10" should be considered to include any and all subranges between (and inclusive of) the minimum value of 1 and the maximum value of 10; that is, all subranges beginning with a minimum value of 1 or more, e.g. 1 to 6.1, and ending with a maximum value of 10 or less, e.g., 5.5 to 10.

The following examples will serve to further illustrate the present invention without, at the same time, however, constituting any limitation thereof. On the contrary, it is to be clearly understood that references may be made to various embodiments, modifications and equivalents thereof which, after reading the description herein, may suggest themselves to those skilled in the art without departing from the spirit of the invention.

Figure 1:
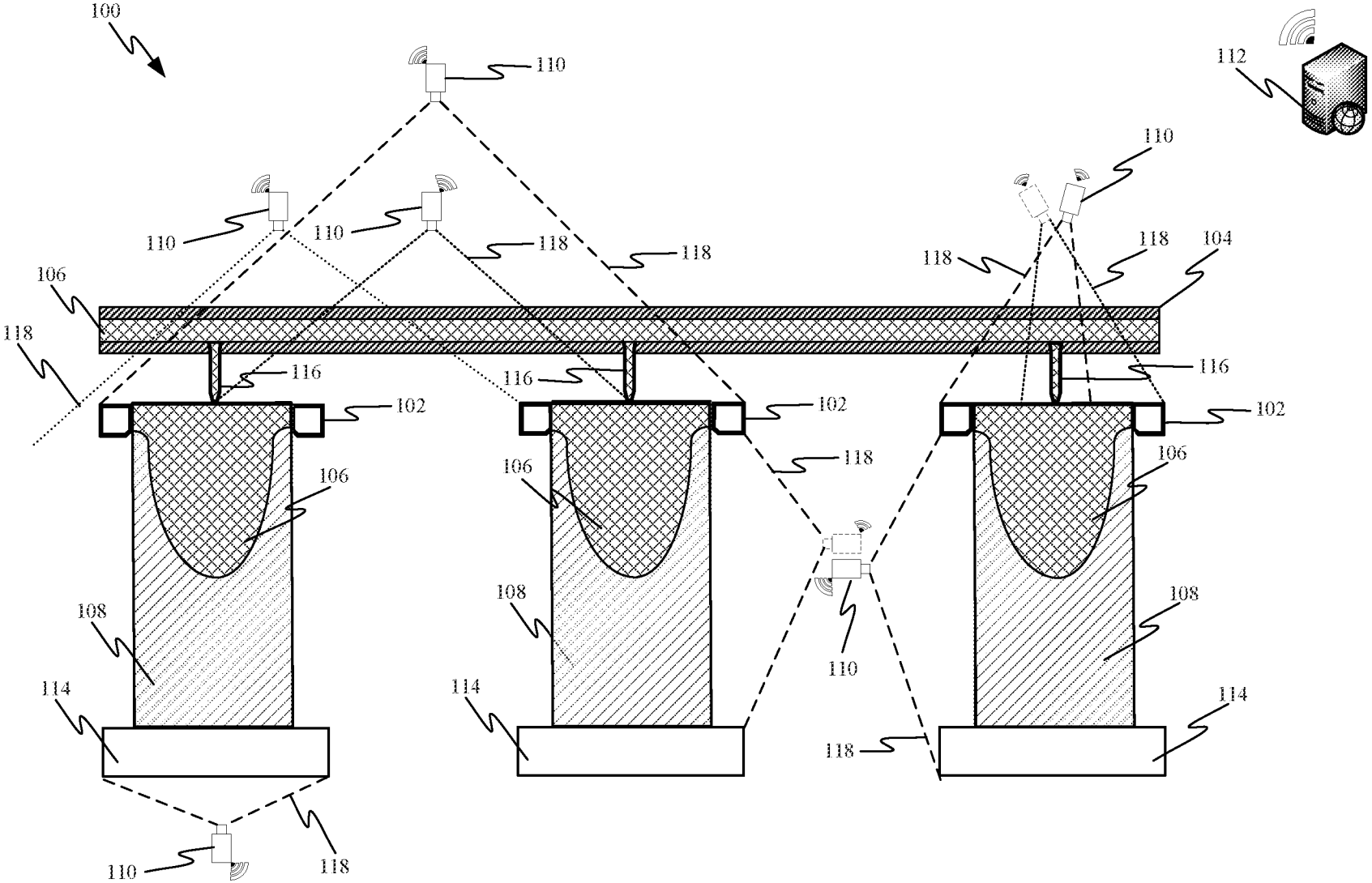
FIG. 1 is a depiction of a system for monitoring a casting environment, according to various embodiments.

FIG. 1 illustrates a monitoring system 100 for monitoring a casting environment including one or more molds 102 and associated components, according to certain embodiments. The monitoring system 100 may include any number of components, however, in various embodiments, the monitoring system 100 includes a launder 104 positioned above one or more molds 102. The launder 104 may include one or more openings for depositing molten metal 106 into the molds 102. The molten metal 106 may cool into a solid or semi-solid ingot 108 during the casting process. One or more cameras 110 may be positioned in the casting environment to detect or capture optical data associated with one or more components. For example, the cameras 110 may capture optical data associated with the molten metal 106. The optical data may be processed using computer system 112 to monitor one or more casting operations.

Using the monitoring system 100, various components used in the casting process may be monitored remotely. For example, using cameras, such as cameras 110, the casting environment and/or the casting components may be monitored. Remote monitoring allows a user to remain outside of the casting environment or enter for a shorter time than would otherwise be required. Additionally, multiple aspects of the casting environment may be monitored at the same time, reducing the need for additional monitoring systems. The remote monitoring may also allow some or all of the monitoring system 100 to be positioned further away from one or more heat sources in the casting environment. For example, instead of having sensing equipment positioned near or attached to the mold 102 where they may be subjected to extreme heat from the molten metal 106, the cameras 110 may be positioned away from the mold 102 and/or the molten metal 106 in a cooler environment. Positioning the monitoring equipment away from the heat sources may additionally or alternatively reduce the amount of repairs and replacements, saving time and money.

The molds 102 may be positioned in the casting environment and receive molten metal 106 into a mold opening. The mold 102 may include material that may withstand the heat of molten metal 106 as it cools to form the ingot 108. For example, the mold 102 may include graphite. The mold 102 may have any suitable shape or design for receiving and cooling the molten metal 106. In various embodiments, the mold 102 may have a rectangular cross-section with four mold walls and an open top for receiving the molten metal 106 and an open bottom allowing for the ingot 108 to exit. In some embodiments, the mold 102 may include or cooperate with a bottom block 114 for forming the ingot 108, such as may commonly be the case in a mold 102 used in direct chill casting. The bottom block 114 may be moveable or stationary. In some embodiments, the bottom block 114 may be a starting head mounted on a telescoping hydraulic table. In alternative embodiments, the mold 102 may be any type and shape suitable for casting molten metal 106.

In various embodiments, the mold 102 may additionally or alternatively aid in the cooling of the molten metal 106 to form the ingot 108. In a non-limiting example, the mold 102 is a water-cooled mold. For example, the mold 102 may include a cooling system that uses one or more of air, glycol, or any suitable medium for cooling. In various embodiments, the mold 102 may have heated walls to retard mold wall cooling (e.g., an Ohno Continuous Caster (OCC) mold may be used).

The ingot 108 may be formed by the molten metal 106 being cooled by the walls of the mold 102. For example, the molten metal 106 may be deposited into the mold 102 and begin to solidify, forming the ingot 108. The bottom block 114 may be steadily lowered while additional molten metal 106 is added to the top of the mold 102, lengthening the ingot 108.

The molten metal 106 and/or the ingot 108 may be formed from any metal or combination of metals capable of being heated to a melting temperature. In a non-limiting example, the molten metal 106 and/or the ingot 108 includes aluminum. In various embodiments, the molten metal 106 and/or the ingot 108 may include iron, magnesium, or a combination of metals.

As mentioned above, the molten metal 106 may be deposited into the one or more molds 102 by one or more launders 104 positioned adjacent to the mold. The launders 104 may contain one or more openings for depositing the molten metal 106 into the one or more molds 102. In various embodiments, the launder 104 may be positioned above the one or more molds 102 and deposit the molten metal 106 into the one or more molds 102 from the one or more openings. The launder 104 may be any size and shape suitable for containing and dispensing the molten metal 106. As depicted, the launder 104 has a rectangular shape with a U-shaped channel for containing the molten metal 106. In some embodiments, the launder 104 may have any suitable size and shape for depositing molten metal 106 into the one or more molds 102.

In various embodiments, the launder 104 may include a flow control device 116. The flow control device 116 may control the flow rate of the molten metal 106 from the launder 104 to the one or more molds 102. As described below with respect to FIG. 2, the flow control device 116 may include a pin positioned in an opening to control the flow of the molten metal 106 into the one or more molds 102.

One or more cameras 110 may be positioned in the casting environment to capture or detect optical data. In various embodiments, the cameras 110 may be positioned to detect optical data related to the one or more molds 102. The cameras 110 may be or include optics capable of capturing still or moving images, thermal images, infrared images, x-rays, or any suitable optical data. In various embodiments, the cameras 110 may send the optical data to the computer system 112 for processing. In some embodiments, the cameras 110 may be or include components that allow some or all of the optical data to be processed by the cameras.

The cameras 110 may have a field of view 118 that includes at least a portion of a mold 102. In some embodiments, the cameras 110 may be moveable or repositionable to change the field of view 118. For example, the cameras 110 may pivot to detect optical data associated with two adjacent molds 102. The camera 110 may be positioned facing one or more of the molds 102 or otherwise have a field of view 118 including at least a portion of the mold 102. In various embodiments, a camera 110 is positioned above the mold 102 with a field of view 118 that includes at least a portion of the top of the mold 102. A camera 110 may additionally or alternatively be positioned beneath the mold 102 with a field of view that includes at least a portion of the bottom of the mold 102.

In various embodiments, the cameras 110 may be positioned at any suitable orientation to have a field of view 118 that includes the casting environment and/or any suitable component positioned in or adjacent to the casting environment. For example, the cameras 110 may have a field of view 118 that includes the casting environment and a portion of a mold 102 positioned in the casting environment. The cameras 110 may be positioned in the casting environment or positioned outside the casting environment. In further embodiments, the orientation of the cameras 110 are adjustable to include the casting environment and/or any suitable component positioned in or adjacent to the casting environment.

The monitoring system 100 may include multiple cameras 110 working in conjunction. The multiple cameras 110 may be positioned to have adjacent or overlapping fields of view 118. For example, two cameras 110 may be mounted at different heights above the mold 102 and may have overlapping fields of view 118 of the mold 102. As another example, two or more cameras 110 may be mounted so that each camera 110 has a field of view 118 of a portion of one side of the mold 102. Each field of view 118 may be combined to form an image of an entire side of the mold 102 or other aggregate areas of interest.

Figure 4:
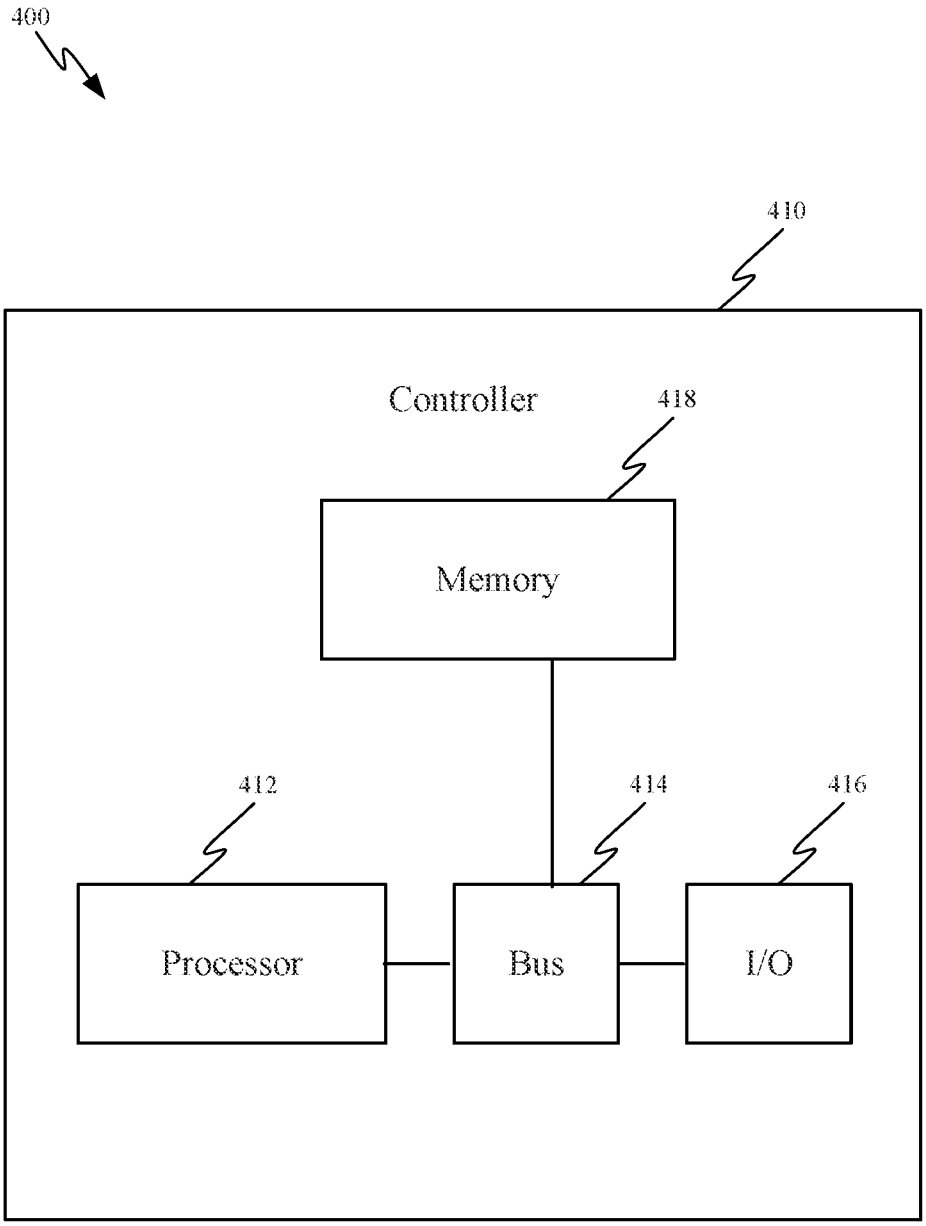
FIG. 4 illustrates an example computer system for use with the monitoring system of FIG. 1, according to various embodiments.

A computer system 112 may receive the optical data from the cameras 110. The computer system 112 may include hardware and software for executing computer-executable instructions. For example, the computer system 112 may include memory, processors, and an operating system for executing the computer-executable instructions (FIG. 4). The computer system 112 may have hardware or software capable of communicating with other devices through a wired connection or a wireless connection (e.g., Bluetooth). The computer system 112 may be in communication with one, some combination, or all of: the flow control device 116, the camera 110, or any other suitable components associated with the casting environment.

In various embodiments, the computer system 112 may be in a single physical location. For example, the computer system 112 may be hardware and software located in the same manufacturing facility as the one or more molds 102 and communicating with the cameras 110 over a local communication network (e.g., Wi-Fi or Bluetooth). In some embodiments, one or more computer systems 112 may be located in multiple physical locations and communicate with the cameras 110 via long range communication (e.g., the internet, radio waves, or satellites). For example, the computer system 112 may be a cloud computing system including any number of internet connected computing components.

The computer system 112 may contain hardware and software capable of enabling execution of the steps of: receiving optical data from the camera(s) 110, analyzing the received data, and generating operating instructions for a casting operation. Some or all of these steps may be performed by a single computer system 112 or multiple computer systems.

In various embodiments, the computer system 112 may contain hardware and software capable of enabling execution of the steps of depositing molten metal 106 in the mold 102 as part of a casting operation, receiving optical data associated with the ingot 108, operating a diverter 510, determining separation of the ingot 108 from the bottom block 114, and generating operating instructions for the casting operation.

In various embodiments, the computer system 112 may alert a user based on the optical data received from the cameras 110. For example, the computer system 112 may activate an alarm in response to the optical data. The alarm may correspond to or include a bell, a light, a siren, a display, a speaker, or any other object capable of getting the attention of a user or the system and/or conveying information to the user or the system.

Other actions may be prompted in addition to or in lieu of activating the alarm. In various embodiments, a change in the flow of the molten metal 106 into the one or more molds 102 may be introduced along with or instead of activation of the alarm. For example, the flow control device 116 may be controlled to increase, decrease, or otherwise change the flow rate, amount, or other characteristic of the flow of molten metal 106 into the mold 102. In various embodiments, an alert additionally or alternatively may be displayed, logged, sent, or otherwise communicated to a user or another aspect of the system (e.g., and may be independent of or performed in conjunction with activating the alarm and/or changing the flow of the molten metal 106).

Figure 2:
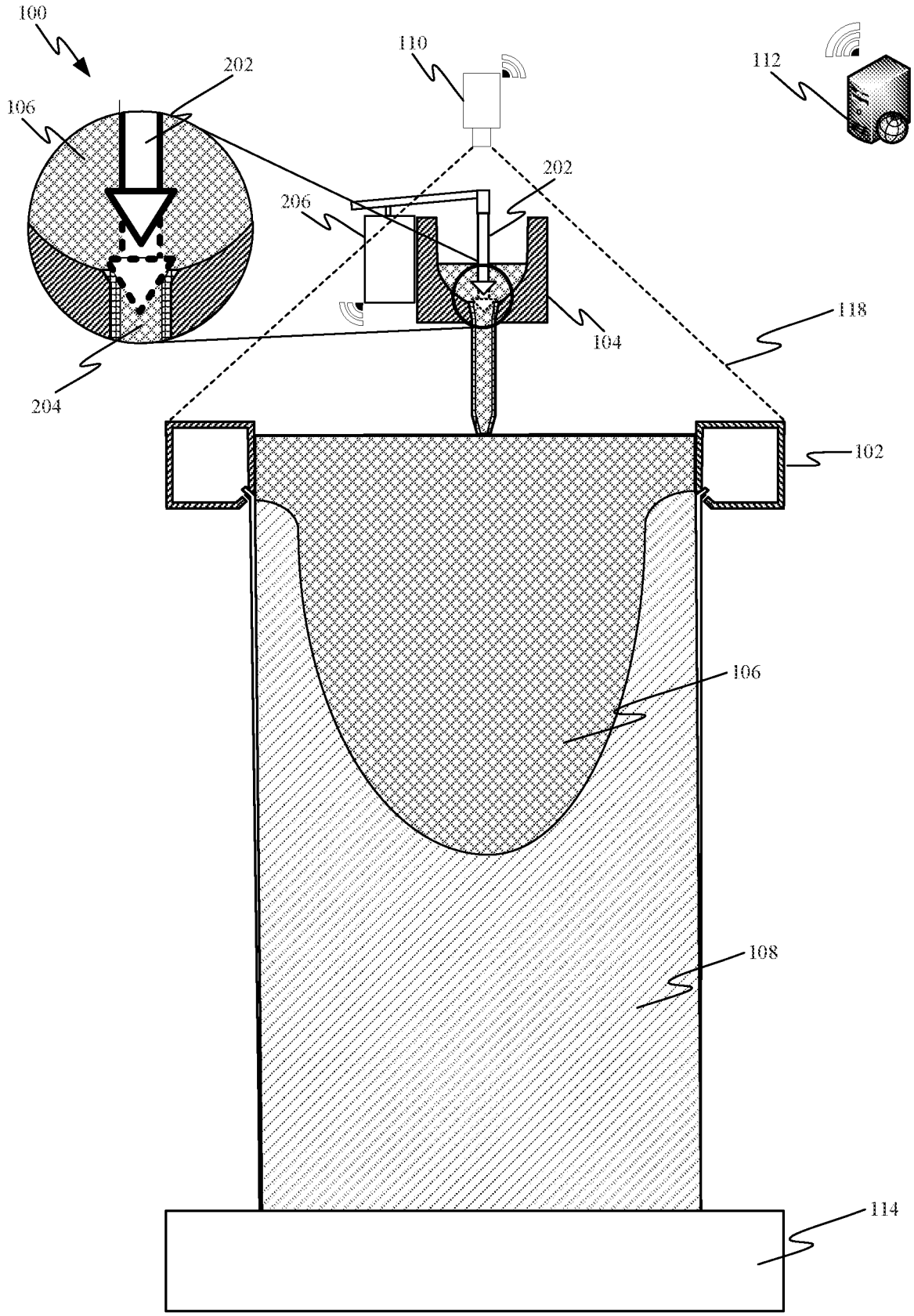
FIG. 2 is a cross-section of a portion of the monitoring system of FIG. 1, according to various embodiments.

Turning to FIG. 2, a cross-section of a portion of the monitoring system 100 of FIG. 1 is shown. The portion of the monitoring system 100 includes a mold 102, a camera 110, and a launder 104. The launder 104 may include a flow control device 116 for controlling the molten metal flowing from the launder to the mold 102. The flow control device 116 may include a pin 202 positioned in an opening 204. The pin 202 may be attached to a motor 206 for moving the pin relative to the opening 204.

The pin 202 may be positioned in the opening 204 of the launder 104. The opening 204 and/or the pin 202 may be tapered such that moving the pin downwards relative to the opening makes the annulus between the pin and the opening smaller. The pin 202 may be raised and/or lowered to adjust the flow of molten metal 106 out of the launder 104. For example, the pin 202 may be raised to enlarge the annulus between the pin and the opening 204, increasing the molten metal 106 flowing out of the launder 104 (e.g., as shown in solid lines). Further, the pin 202 may be lowered to shrink the annulus between the pin and the opening 204, decreasing and/or stopping the flow of the molten metal 106 out of the launder 104 (e.g., as shown in dashed lines).

The pin 202 may be raised and/or lowered by the motor 206. In various embodiments, the motor 206 may be in communication with the computer system 112 for automatic raising and/or lowering of the pin 202. In various embodiments, the pin 202 may be raised and/or lowered manually. In some examples, the manual raising and/or lowering of the pin 202 may be prompted by the computer system 112. In some embodiments, the pin 202 may be automatically raised and/or lowered to maintain the level of the molten metal 106 in the mold 102 within a range of a threshold value. The pin 202 may additionally or alternatively be automatically raised and/or lowered in response to detecting a gap between the ingot 108 and the bottom block 114. Further, the pin 202 may be automatically raised and/or lowered in response to detecting one or more of a leak in the mold, cracks in the mold, dust on the mold, rust on the mold, misalignment of the mold, moisture in the mold, metal in the mold, platen engagement, platen position, platen drift, and/or a failure of the cooling system.

In various embodiments, the pin 202 may be raised and/or lowered (e.g., the pin may be pulsed) based on one or more conditions of the molten metal 106 and/or the mold 102. For example, the pin 202 may be raised and lowered in response to the molten metal 106 pulling away from the mold 102. In some embodiments, the pin 202 may be raised and lowered at timed intervals to adjust the flow of molten metal 106 into the mold 102. Pulsing the pin 202 may cause the molten metal 106 flowing into the mold 102 to disrupt the surface tension of the molten metal in the mold 102. Disrupting the surface tension of the molten metal 106 in the mold 102 may cause molten metal to flow more readily along the surface of the molten metal in the mold. In further embodiments, the flow control device 116 may additionally or alternatively include a valve, a stop, a funnel, or other suitable structure.

Figure 3:
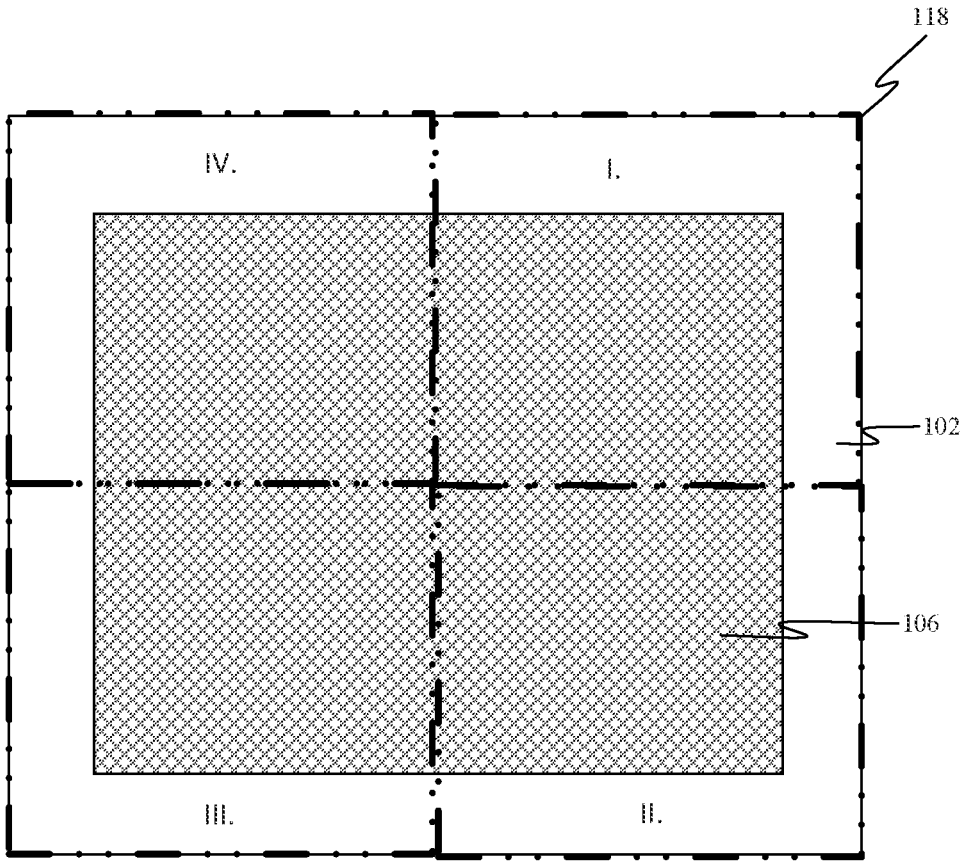
FIG. 3 is a top view of a portion of the monitoring system of FIG. 1, according to various embodiments.

Turning to FIG. 3, an example of a field of view 118 of a camera 110 is depicted. The field of view 118 may include the walls of the mold 102, the molten metal 106, and/or the ingot 108. As depicted in the example of FIG. 3, the field of view 118 includes one side of a mold 102 (e.g., a top side) and an entire perimeter of that side of the mold 102. However, the field of view 118 may include a sub-portion of a perimeter of a mold 102, portions of multiple molds, multiple sides of a mold 102, or multiple sides of multiple molds.

By way of example, the field of view 118 is depicted as being split into four quadrants (e.g., I, II, III, IV). However, the field of view 118 may include more or less quadrants. A single camera 110 may have a field of view 118 that includes all four quadrants. However, a single camera 110 may have a field of view 118 that corresponds to a single quadrant or subset of quadrants. Additionally or alternatively, a single camera 110 may have a field of view 118 that corresponds to a combination of quadrants. In some embodiments, a single camera 110 may have multiple fields of view 118 (e.g., each quadrant is a different field of view 118) that the camera 110 may switch between. For example, a moveable camera 110 may switch between fields of view 118 as the camera 110 pans around the top of the mold 102. In various embodiments, the quadrants may include a mark that correspond to coordinates of locations on the ingot 108 and/or the mold 102.

FIG. 4 is an example computer system 400 for use with the monitoring system 100 shown in FIG. 1. In various embodiments, the computer system 400 includes a controller 410 that is implemented digitally and is programmable using conventional computer components. The controller 410 may be used in connection with certain examples (e.g., including equipment such as shown in FIG. 1) to carry out the processes of such examples. The controller 410 includes a processor 412 that may execute code stored on a tangible computer-readable medium in a memory 418 (or elsewhere such as portable media, on a server or in the cloud among other media) to cause the controller 410 to receive and process data and to perform actions and/or control components of equipment such as shown in FIG. 1. The controller 410 may be any device that may process data and execute code that is a set of instructions to perform actions such as to control industrial equipment. As non-limiting examples, the controller 410 may take the form of a digitally implemented and/or programmable PID controller, a programmable logic controller, a microprocessor, a server, a desktop or laptop personal computer, a laptop personal computer, a handheld computing device, and a mobile device.

Examples of the processor 412 include any desired processing circuitry, an application-specific integrated circuit (ASIC), programmable logic, a state machine, or other suitable circuitry. The processor 412 may include one processor or any number of processors. The processor 412 may access code stored in the memory 418 via a bus 414. The memory 418 may be any non-transitory computer-readable medium configured for tangibly embodying code and may include electronic, magnetic, or optical devices. Examples of the memory 418 include random access memory (RAM), read-only memory (ROM), flash memory, a floppy disk, compact disc, digital video device, magnetic disk, an ASIC, a configured processor, or other storage device.

Instructions may be stored in the memory 418 or in the processor 412 as executable code. The instructions may include processor-specific instructions generated by a compiler and/or an interpreter from code written in any suitable computer-programming language. The instructions may take the form of an application that includes a series of setpoints, parameters, and programmed steps which, when executed by the processor 412, allow the controller 410 to monitor and control various components of the monitoring system 100. For example, the instructions may include instructions for a machine vision application.

The controller 410 shown in FIG. 4 includes an input/output (I/O) interface 416 through which the controller 410 may communicate with devices and systems external to the controller 410, including components such as the flow control device 116 or the camera 110. The input/output (I/O) interface 416 may also, if desired, receive input data from other external sources. Such sources may include control panels, other human/machine interfaces, computers, servers or other equipment that may, for example, send instructions and parameters to the controller 410 to control its performance and operation; store and facilitate programming of applications that allow the controller 410 to execute instructions in those applications to monitor the various components in the casting process; and other sources of data necessary or useful for the controller 410 in carrying out its functions. Such data may be communicated to the input/output (I/O) interface 416 via a network, hardwire, wirelessly, via bus, or as otherwise desired.

Figure 5B:
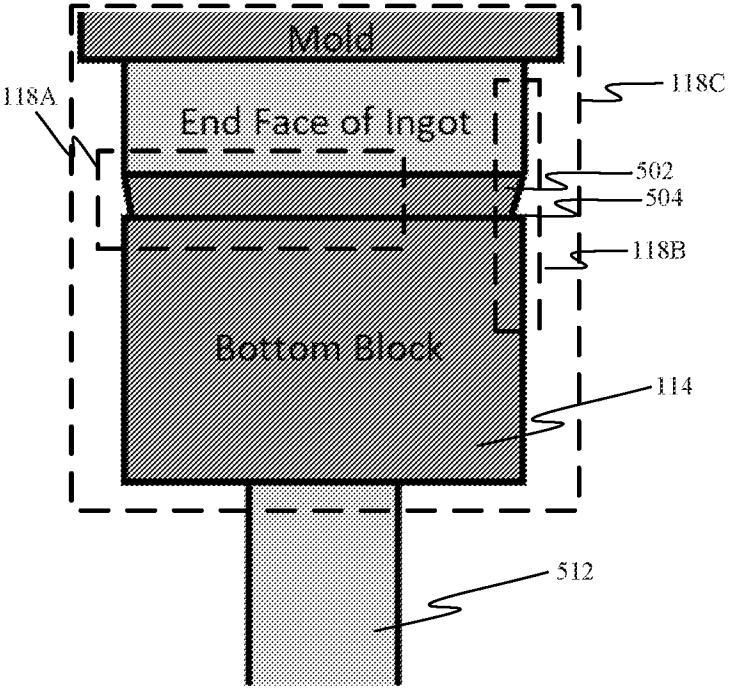
FIGS. 5A and 5B illustrate a portion of an example casting system for use with the monitoring system of FIG. 1, according to various embodiments.
Figure 5A:
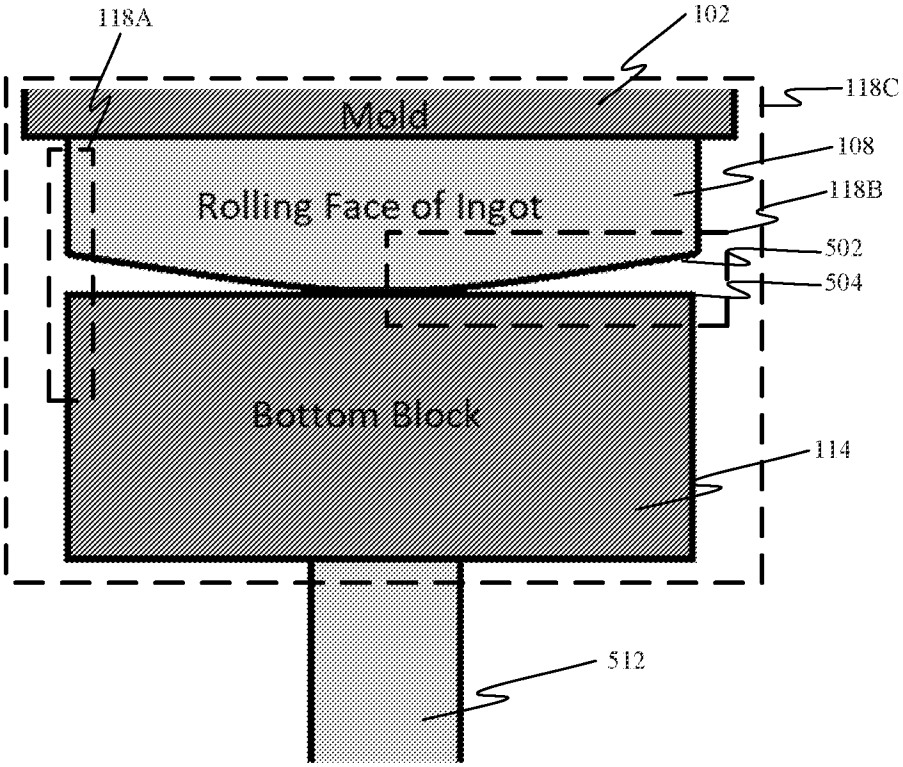

Turning to FIGS. 5A and 5B, various fields of view 118 of cameras 110 are shown, according to various embodiments. FIG. 5A illustrates a front view of the mold 102, the ingot 108, the bottom block 114, and various fields of view 118 that may be used as part of the monitoring system 100 and FIG. 5B illustrates a side view. The fields of view 118 may be for a single camera 110 or may be from multiple cameras. The fields of view 118 may include some or all of the mold 102, ingot 108 and/or bottom block 114. For example, the fields of view 118 may include a portion of the ingot 108 and the bottom block 114 (e.g., 118A and 118B) or the mold 102, ingot 108 and bottom block 114 (e.g., 118C). The fields of view 118 may allow for the monitoring of the ingot 108 and/or the bottom block 114. For example, the fields of view 118 may include a portion of the bottom 502 of the ingot 108 and/or the top 504 of the bottom block 114. In various embodiments, the bottom block 114 may be lowerable using mechanism 512. The mechanism 512 may be or include a lift (e.g., a hydraulic lift). The mechanism 512 may be controllable (e.g., by computer system 112) to lower the bottom block 114. The mechanism 512 may lower the bottom block 114 at a constant rate, however, the bottom block may be lowered at a variable rate.

As shown in FIGS. 5A and 5B, the bottom 502 of the ingot 108 may separate from the top 504 of the bottom block 114. The separation may be detected and/or captured by cameras 110 as optical data. The separation may be caused by the cooling of the ingot 108. The cooling of the ingot 108 may cause the bottom 502 of the ingot 108 to curl up, leaving a gap between the bottom of the ingot and the top 504 of the bottom block 114. Knowing the height of the gap may allow for determining the appropriate cooling rate of the ingot 108. The cooling rate of the ingot 108 may be used to adjust the casting process. For example, the rate of lowering of the bottom block 114 may be adjusted based on the rate of cooling.

Using cameras 110, the gap may be measured between the bottom 502 of the ingot 108 and the top 504 of the bottom block 114. Measuring the gap using cameras 110 allows for the gap to be measured without placing components on the ingot 108, bottom block 114, and/or the mold 102. Further, measuring the gap using cameras 110 allows an operator to measure the gap without having to enter the casting environment. In some embodiments the gap may be between 0.1 inches and 4 inches, however, the gap may be any suitable distance.

In various embodiments, the cameras 110 may be or include a thermal camera and/or infrared camera. The field of view 118 may detect the temperature and/or the thermal properties of components positioned in the field of view. In some embodiments, black lights may be used in conjunction with neon crayons to aid in measuring of the gap. For example, the ingot 108 and/or the bottom block 114 may be marked with the neon crayon that is highlighted by the black light. The cameras 110 may detect and/or capture the neon crayon as optical data.

Figure 6B:
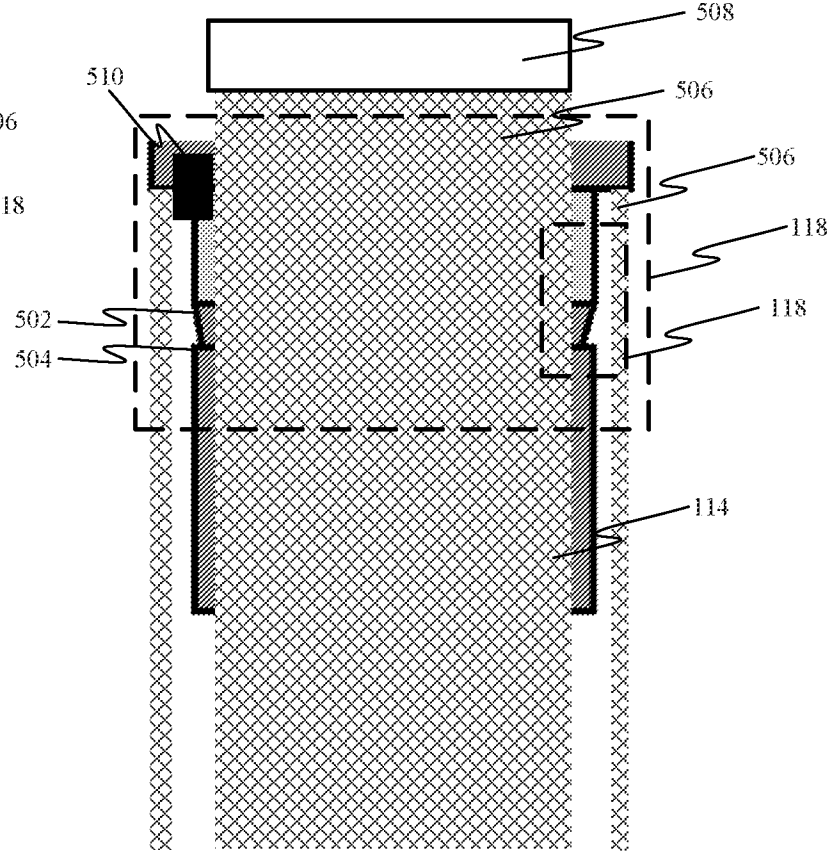
FIGS. 6A and 6B illustrate a portion of the example casting system of FIGS. 5A and 5B during a casting process, according to various embodiments.
Figure 6A:
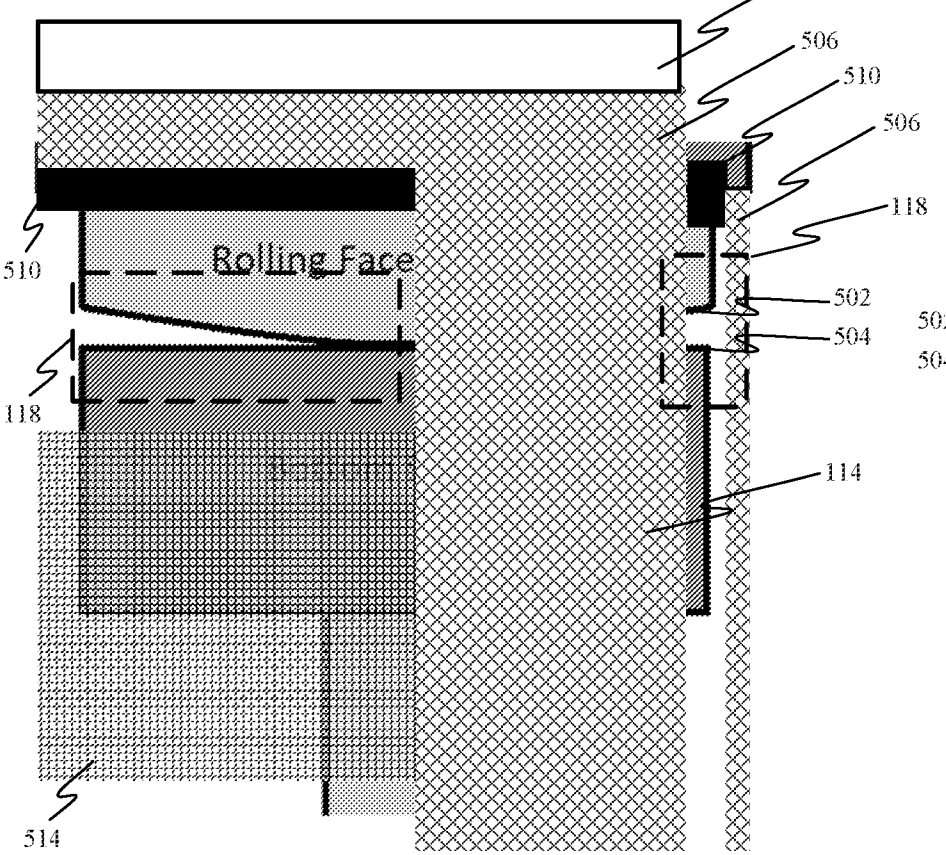

Turning to FIGS. 6A and 6B, one or more features of the casting system may block the fields of view 118. For example, water 506 may flow across one or more sides of the ingot 108 between the ingot and the cameras 110. The water 506 may block some or all of the fields of view 118. The water 506 may flow from one or more water sources 508. The water sources 508 may cause the flow of water 506 over the ingot 108. In some embodiments, the water sources 508 may be coupled with the mold 102 to flow the water 506 through the mold. The water 506 flowing through the mold 102 may flow out of the bottom of the mold 102 and down one or more faces of the ingot 108. In various embodiments, steam 514 may additionally or alternatively block the fields of view 118. The steam 514 may form from the water 506 being heated during the casting process. The steam 514 may block one or more cameras 110 from being able to detect optical data associated with the ingot 108 and/or the bottom block 114. The cameras 110 may be or include a thermal camera that may be used to detect thermal data associated with the ingot 108 and/or bottom block 114. The thermal camera may send the thermal data to the computer system 112. The infrared data may be used to generate an outline and/or edge profile of the ingot 108 and/or the bottom block 114.

In various embodiments, a diverter 510 may divert the water 506 and/or the steam 514. The water 506 may be diverted away from a portion of the ingot 108. The diverted water 506 and/or steam 514 may allow the cameras 110 (e.g., the thermal camera) to detect the thermal data associated with the ingot 108 and/or the bottom block 114 with minimal interference from the hot water and/or steam. For example, when the water 506 and/or the steam 514 is being diverted, the cameras 110 can measure the distance between the bottom 502 of the ingot 108 and the top 504 of the bottom block 114. The diverter 510 may be coupled to the mold 102 and/or may be integrated into the mold 102. For example, the diverter 510 may be or include a plug positioned in the mold 102 that prevents water 506 from flowing through the mold 102. The diverter 510 may additionally or alternatively be attached to the exterior of the mold 102. For example, the diverter 510 may be a device positioned beneath the mold 102 that blocks and/or diverts the water 506 after it has flowed through the mold. The diverter 510 may be or include an air jet, a fan, a sheet, or a plug.

Figure 7:
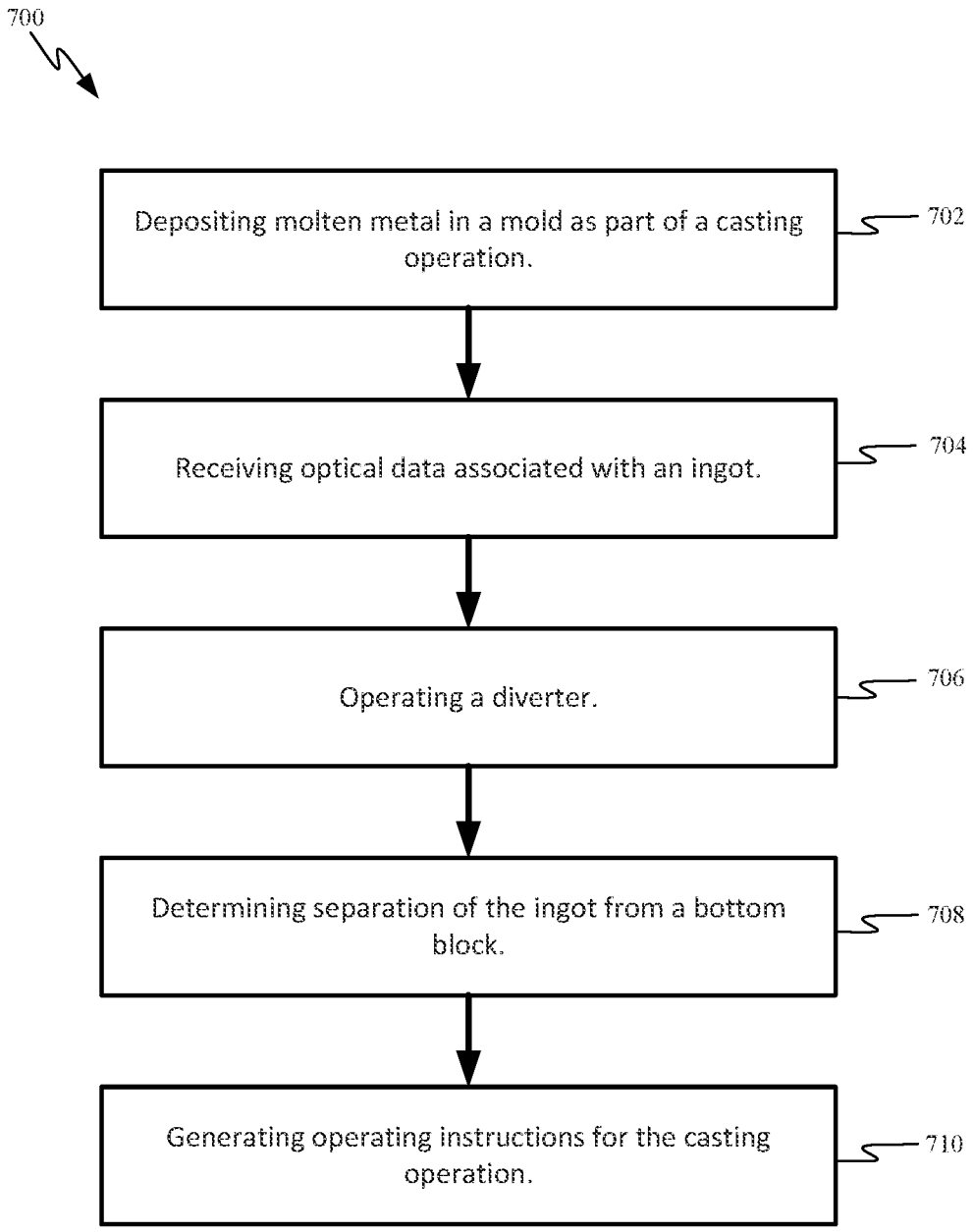
FIG. 7 is a flowchart representing an example process for using the monitoring system, according to various embodiments.

Turning to FIG. 7, a flowchart representing an example process 700 for using the monitoring system 100 is shown. Some or all of the process 700 (or any other processes described herein, or variations, and/or combinations thereof) may be performed under the control of one or more computer systems configured with executable instructions and may be implemented as code (e.g., executable instructions, one or more computer programs, or one or more applications) executing collectively on one or more processors, by hardware or combinations thereof. The code may be stored on a computer-readable storage medium, for example, in the form of a computer program comprising a plurality of instructions executable by one or more processors. The computer-readable storage medium may be non-transitory. Moreover, unless indicated otherwise, acts shown in the processes are not necessarily performed in the order shown and/or some acts may be omitted in embodiments.

The process 700 at 702 may include depositing metal, such as molten metal 106, into one or more molds, such as mold 102. The molten metal 106 may be deposited into the mold 102 by a launder 104 as described herein. The launder 104 may deposit the molten metal 106 into the mold 102 through one or more openings in the launder 104. The amount or flow rate of the molten metal 106 entering the mold 102 may be adjusted by controlling a flow control device 116. The molten metal 106 may enter the mold 102 through an opening in the mold 102. The molten metal 106 contained by the mold 102 may contact one or all walls of the mold 102. The temperature of the molten metal 106 may decrease after entering the mold 102 and the molten metal 106 may cool and become a solid or semi-solid ingot 108.

The process 700 at 704 may include receiving optical data associated with the ingot 108. The optical data may be captured or detected using cameras, such as cameras 110. The cameras 110 may have a field of view 118 that includes the mold 102, the ingot 108, and the bottom block 114. In various embodiments, the field of view 118 includes a portion of the ingot 108 (e.g., an edge) and the bottom block 114. Multiple cameras 110 may be positioned to have overlapping fields of view 118, a single camera may have multiple fields of view, or multiple cameras may have individual fields of view. The cameras 110 may be positioned to capture or detect optical data associated with the mold 102 and/or the molten metal 106. For example, the cameras 110 may capture optical data associated with the gap between the ingot 108 and the bottom block 114. The computer system 112 may receive the optical data from the cameras 110 and/or from a database. For example, the computer system 112 may receive optical data from a database containing optical data associated with different molds. In various embodiments, the cameras 110 may be or include thermal and/or infrared cameras. The thermal and/or infrared cameras may detect optical data that includes a thermal and/or infrared profile of the ingot 108 and/or the bottom block 114. The thermal and/or infrared cameras may be able to detect optical data that may otherwise not be visible to the cameras 110. For example, the ingot 108 and/or the bottom block 114 may be blocked from the view of a "normal" camera (e.g., one that receives and/or process light that is visible to the human eye) but a thermal or infrared camera may be able to detect the thermal and/or infrared profile of the ingot and/or the bottom block. For example, a thermal camera may detect elevated levels of heat from the ingot 108 and thus "see through" or not be blocked by an intervening layer of water (e.g., which may be at a significantly lower temperature than the ingot) and/or an intervening layer of steam. The thermal and/or infrared profile can include some or all of the optical data that is included with an image captured and/or detected by a non-thermal camera.

The process 700 at 706 can include operating the diverter 510. The diverter 510 may be operated to divert water 506 and/or steam 514 away from the area that is being detected by cameras 110. For example, the diverter 510 may divert the water 506 and/or the steam 514 away from the field of view 118. As an illustrative example, diverter 510 may include an air jet that is operated to divert the water 506 and/or the steam 514 away from the area that is being detected. In some embodiments, the diverter 510 may be activated prior to capturing the optical data and de-activated after the optical data has been detected. However, the diverter 510 may divert the water 506 and/or the steam 514 when the optical data is not being detected.

The process 700 at 708 may include determining separation of the ingot 108 from the bottom block 114. For example, using the optical data from the cameras 110, the computer system 112 may determine if the ingot 108 has separated from the bottom block 114. The computer system 112 may determine the distance of separation from the bottom 502 of the ingot 108 and the top 504 of the bottom block. In various embodiments, the separation of the ingot 108 and the bottom block 114 may be determined by comparing the outlines and/or edge profiles of the ingot 108 and/or the bottom block 114 detected by the camera 110 (e.g., a thermal camera). For example, the bottom block 114 can have a very high temperature gradient and the edge profile will be differentiable from the edge profile of the ingot 108. The distance between the ingot 108 and the bottom block 114 may be determined by measuring the distance between the edge profiles.

The process 700 at 710 may include generating operating instructions for the casting operation. The operating instructions may include instructions to make changes to the casting process or may include instructions to continue the casting operation without any changes. Operating instructions may be based on the separation between the ingot 108 and the bottom block 114. For example, based on the distance between the ingot 108 and the bottom block 114, the casting process may be adjusted. In various embodiments, the operating instructions may include adjusting the rate of lowering of the bottom block 114, the flow rate of the molten metal 106 into the mold 102, the amount of water 506 flowing into the mold, the duration of activation of the diverter 510, or any suitable instructions. In various embodiments, the operating instructions may include instructions for a user that if not acted upon cause the computer system 112 to automatically execute the instructions. For example, the instructions may prompt a user to adjust one or more parameters associated with casting of the ingot 108, and if the user does not execute the instructions in a timely manner, the computer system 112 may automatically adjust the parameters.

All patents, publications and abstracts cited above are incorporated herein by reference in their entirety. The foregoing description of the embodiments, including illustrative aspects of embodiments, has been presented only for the purpose of illustration and description and is not intended to be exhaustive or limiting to the precise forms disclosed. Numerous modifications, adaptations, and uses thereof will be apparent to those skilled in the art.

ASPECTS

Aspect 1 is a system for monitoring a mold, comprising: a mold defining an opening to receive molten metal and comprising a bottom block lowerable during a casting of the molten metal into an ingot; a launder configured to deliver the molten metal to the mold; a water source configured to provide water to the mold; a diverter configured to divert the water away from a portion of the ingot; a camera having a field of view including at least the portion of the ingot that the water has been diverted away from, the camera configured to capture optical data associated with the ingot; and a controller comprising a processor configured to execute instructions stored on a non-transitory computer-readable medium in a memory, the controller causing the processor to perform processor operations including: receiving optical data associated with the portion of the ingot or the portion of the bottom block; determining, based on the optical data, whether separation of the portion of the ingot from the portion of the bottom block has occurred; and generating operating instructions for casting the molten metal into the ingot if it was determined that the separation has occurred.

Aspect 2 is the system of aspect(s) 1 (or of any other preceding or subsequent aspects individually or in combination), wherein the processor operations further includes: determining, based on whether the portion of the ingot has separated from the bottom block, a distance between the portion of the ingot and the bottom block; and generating operating instructions based on at least the distance between the portion of the ingot and the bottom block.

Aspect 3 is the system of aspect(s) 2 (or of any other preceding or subsequent aspects individually or in combination), wherein the operating instructions comprise at instructions for least one of adjusting a rate of lowering of the bottom block, adjusting a flow rate of the molten metal, or adjusting a flow rate of the water.

Aspect 4 is the system of aspect(s) 1 (or of any other preceding or subsequent aspects individually or in combination), wherein the processor operations further comprise, prior to receiving the optical data, operating the diverter to divert the water away from the portion of the ingot.

Aspect 5 is the system of aspect(s) 1 (or of any other preceding or subsequent aspects individually or in combination), wherein the optical data includes at least one of an image or an infrared profile.

Aspect 6 is the system of aspect(s) 1 wherein the launder comprises a flow control device configured to adjust a flow rate of the molten metal from the launder to the mold for casting the molten metal into an ingot, the water flows from the mold during the casting of the molten metal into the ingot, and the field of view of the camera further includes at least a portion of the bottom block and a portion of the ingot and configured to capture optical data associated with the portion of the ingot or the portion of the bottom block, and wherein the processor operations further comprise: capturing first optical data associated with the portion of the ingot; generating a profile associated with the portion of the ingot based on at least the first optical data; comparing the profile with a baseline profile; and determining, based on the comparing, whether the portion of the ingot has separated from the bottom block.

Aspect 7 is the system of aspect(s) 6 (or of any other preceding or subsequent aspects individually or in combination), wherein the camera comprises an infrared camera and the optical data associated with the ingot comprises an infrared profile associated with the portion of the bottom block or the portion of the ingot.

Aspect 8 is the system of aspect(s) 6 (or of any other preceding or subsequent aspects individually or in combination), wherein the operating instructions comprise instructions for operating the flow control device to adjust the flow rate of the molten metal into the mold, adjusting a flow rate of the water to the mold, or adjusting movement speed of the bottom block.

Aspect 9 is the system of aspect(s) 6 (or of any other preceding or subsequent aspects individually or in combination), wherein determining whether separation of the portion of the ingot from the portion of the bottom block has occurred comprises determining a separation distance between the portion of the ingot and the portion of the bottom block.

Aspect 10 is the system of aspect(s) 9 (or of any other preceding or subsequent aspects individually or in combination), wherein the separation distance is in a range between 0.1 inch and 4 inches.

Aspect 11 is the system of aspect(s) 6 (or of any other preceding or subsequent aspects individually or in combination), wherein the system further comprises a diverter coupled with the mold and configured to divert the water away from the portion of the ingot.

Aspect 12 is the system of aspect(s) 11 (or of any other preceding or subsequent aspects individually or in combination), wherein the diverter comprises at least one of an air jet, a sheet, or a plug.

Aspect 13 is the system of aspect(s) 6 (or of any other preceding or subsequent aspects individually or in combination), wherein the processor operations further includes: receiving second optical data associated with the portion of the ingot; updating the profile associated with the portion of the ingot based on at least the second optical data; comparing the updated profile with the baseline profile; and determining, based on the comparing, whether the portion of the ingot has separated from the bottom block.

Aspect 14 is the system of aspect(s) 6 (or of any other preceding or subsequent aspects individually or in combination), wherein comparing the profile with a baseline profile comprises comparing an infrared profile of the portion of the ingot with an infrared profile of the bottom block.

Aspect 15 is a method of monitoring a mold, comprising: initiating a casting operation using a casting system including a mold comprising a bottom block and a launder, the casting operation comprising: causing molten metal to flow into the mold; causing water to flow into the mold; cooling the molten metal to form an ingot; and lowering the bottom block; diverting water away from a portion of the ingot; capturing, using a camera, first optical data associated with the portion of the ingot; comparing the first optical data with a baseline profile; and determining, based on the comparing, whether the portion of the ingot has separated from the bottom block.

Aspect 16 is the method of aspect(s) 15 (or of any other preceding or subsequent aspects individually or in combination), further comprising: determining a separation distance between the portion of the ingot and the bottom block; and generating, based on the separation distance, operating instructions for the casting operation.

Aspect 17 is the method of aspect(s) 16 (or of any other preceding or subsequent aspects individually or in combination), wherein adjusting the casting operation comprises changing a flow rate of the molten metal into the mold, changing a flow rate of the water into the mold, or adjusting the lowering of the bottom block.

Aspect 18 is the method of aspect(s) 15 (or of any other preceding or subsequent aspects individually or in combination), further comprising: capturing, using the camera, second optical data associated with the portion of the ingot; comparing the second optical data with the baseline profile;

and determining, based on the comparing, whether the portion of the ingot has separated from the bottom block.

Aspect 19 is the method of aspect(s) 15 (or of any other preceding or subsequent aspects individually or in combination), wherein capturing the first optical data comprises capturing infrared data associated with the portion of the ingot.

Aspect 20 is the method of aspect(s) 15 (or of any other preceding or subsequent aspects individually or in combination), wherein diverting water away from the portion of the ingot comprises operating an air jet.

What is claimed is:

1. A system for monitoring a mold, comprising:

the mold defining an opening to receive molten metal and comprising a bottom block lowerable during a casting of the molten metal into an ingot;

a launder configured to deliver the molten metal to the mold;

a water source configured to provide water to the mold;

a diverter configured to divert the water away from a portion of the ingot;

a camera having a field of view including at least the portion of the ingot that the water has been diverted away from, the camera configured to capture optical data associated with the ingot; and a controller comprising a processor configured to execute instructions stored on a non-transitory computer-readable medium in a memory, the controller causing the processor to perform processor operations including:

receiving optical data associated with the portion of the ingot or a portion of the bottom block;

determining, based on the optical data, whether separation of the portion of the ingot from the portion of the bottom block has occurred; and generating operating instructions for casting the molten metal into the ingot if it was determined that the separation has occurred.

2. The system of claim 1, wherein the processor operations further includes:

determining, based on whether the portion of the ingot has separated from the bottom block, a distance between the portion of the ingot and the bottom block; and generating operating instructions based on at least the distance between the portion of the ingot and the bottom block.

3. The system of claim 2, wherein the operating instructions comprise instructions for at least one of adjusting a rate of lowering of the bottom block, adjusting a flow rate of the molten metal, or adjusting a flow rate of the water.

4. The system of claim 1, wherein the processor operations further comprise, prior to receiving the optical data, operating the diverter to divert the water away from the portion of the ingot.

5. The system of claim 1, wherein the optical data includes at least one of an image or an infrared profile.

6. The system of claim 1 wherein the launder comprises a flow control device configured to adjust a flow rate of the molten metal from the launder to the mold for casting the molten metal into the ingot, the water flows from the mold during the casting of the molten metal into the ingot, and the field of view of the camera further includes at least a portion of the bottom block and a portion of the ingot and configured to capture optical data associated with the portion of the ingot or the portion of the bottom block, and wherein the processor operations further comprise:

capturing first optical data associated with the portion of the ingot;

generating a profile associated with the portion of the ingot based on at least the first optical data;

comparing the profile with a baseline profile; and determining, based on the comparing, whether the portion of the ingot has separated from the bottom block.

7. The system of claim 6, wherein the camera comprises an infrared camera and the optical data associated with the ingot comprises an infrared profile associated with the portion of the bottom block or the portion of the ingot.

8. The system of claim 6, wherein the operating instructions comprise instructions for operating the flow control device to adjust the flow rate of the molten metal into the mold, adjusting a flow rate of the water to the mold, or adjusting movement speed of the bottom block.

9. The system of claim 6, wherein determining whether separation of the portion of the ingot from the portion of the bottom block has occurred comprises determining a separation distance between the portion of the ingot and the portion of the bottom block.

10. The system of claim 9, wherein the separation distance is in a range between 0.1 inch and 4 inches.

11. The system of claim 6, wherein the system further comprises a diverter coupled with the mold and configured to divert the water away from the portion of the ingot.

12. The system of claim 11, wherein the diverter comprises at least one of an air jet, a sheet, or a plug.

13. The system of claim 6, wherein the processor operations further includes:

receiving second optical data associated with the portion of the ingot;

updating the profile associated with the portion of the ingot based on at least the second optical data;

comparing the updated profile with the baseline profile; and determining, based on the comparing, whether the portion of the ingot has separated from the bottom block.

14. The system of claim 6, wherein comparing the profile with a baseline profile comprises comparing an infrared profile of the portion of the ingot with an infrared profile of the bottom block.

15. A method of monitoring a mold, comprising:

initiating a casting operation using a casting system including the mold comprising a bottom block and a launder, the casting operation comprising:

causing molten metal to flow into the mold;

causing water to flow into the mold;

cooling the molten metal to form an ingot; and lowering the bottom block;

diverting water away from a portion of the ingot;

capturing, using a camera, first optical data associated with the portion of the ingot;

comparing the first optical data with a baseline profile; and determining, based on the comparing, whether the portion of the ingot has separated from the bottom block.

16. The method of claim 15, further comprising:

determining a separation distance between the portion of the ingot and the bottom block; and generating, based on the separation distance, operating instructions for the casting operation.

17. The method of claim 16, wherein adjusting the casting operation comprises changing a flow rate of the molten metal into the mold, changing a flow rate of the water into the mold, or adjusting the lowering of the bottom block.

18. The method of claim 15, further comprising:

capturing, using the camera, second optical data associated with the portion of the ingot;

comparing the second optical data with the baseline profile; and determining, based on the comparing, whether the portion of the ingot has separated from the bottom block.

19. The method of claim 15, wherein capturing the first optical data comprises capturing infrared data associated with the portion of the ingot.

20. The method of claim 15, wherein diverting water away from the portion of the ingot comprises operating an air jet.

* * * * *